United States Patent [19]

Johnson

[11] 4,185,870

[45] Jan. 29, 1980

[54] SEAT-OPERATED INTERLOCK

[75] Inventor: Carl B. Johnson, Pontiac, Ill.

[73] Assignee: Pontiac Furniture Industries, Inc., Pontiac, Ill.

[21] Appl. No.: 885,587

[22] Filed: Mar. 13, 1978

[51] Int. Cl.[2] ..... A47C 1/02

[52] U.S. Cl. ..... 297/84; 297/68; 297/322

[58] Field of Search ..... 297/316, 322, 341, 340, 297/342, 83, 270, 271, DIG. 7, 84, 68, 329

[56] References Cited

U.S. PATENT DOCUMENTS

| | | | |
|---|---|---|---|
| 361,804 | 4/1887 | Babka | 297/68 |
| 2,313,023 | 3/1943 | Ruegger | 297/329 |
| 3,295,885 | 1/1967 | Barksdale | 297/84 |
| 3,858,932 | 1/1975 | Crum et al. | 297/329 X |
| 3,869,169 | 3/1975 | Johnson et al. | 297/84 |
| 3,913,152 | 10/1975 | Quackenbush | 297/342 X |
| 4,072,342 | 2/1978 | Johnson et al. | 297/84 |

*Primary Examiner*—James T. McCall

*Attorney, Agent, or Firm*—Fitch, Even & Tabin

[57] ABSTRACT

The invention disclosed is a mechanical interlock latch for action chairs such, for example, as reclining chairs, which prevents movement of the chair out of upright sitting position if the chair is not occupied.

7 Claims, 8 Drawing Figures

82
80
42
44
46
48
78
86
72
69
32

82
80
42
44
46
48
62
78
86
72
69
36

82
80
42
44
46
48
70
71
78
86
72
69
36
20

10
18
50
66
30
16
62
82
59
69
58
80
42
71
60
44
46
72
34
20

SEAT-OPERATED INTERLOCK

This invention relates to action chairs, by which term I mean chairs having body-supporting parts which are movable at the will of the occupant while the chair is occupied. The invention is concerned more particularly with the provision of a seat-operated latch or interlock mechanism which secures the chair parts against movement when the chair is unoccupied.

The invention is illustrated in the accompanying drawings in the context of a wall-clearing recliner chair which, in its aspects not specifically relevant to the present invention, is more fully disclosed and is claimed in my companion copending applications Ser. No. 885,585, filed Mar. 13, 1978 and Ser. No. 885,586, filed Mar. 13, 1978. The first-mentioned application relates in part to those features of the disclosed chair by which the self-contained retractable footrest is extended and the chair also moved bodily forwardly to provide clearance behind the chair for the recline of the backrest. The latter application relates to the reclining mechanism of the chair per se. The subject matter of this invention is presented and claimed separately in this application because, in its broader aspects, it is independent of the particular form of action chair with which it is employed.

In the illustrated case, i.e. when the invention is utilized in the context of the chair of my copending application Ser. No. 885,585, wherein certain of the relatively movable parts are biased for movement under the influence of stored energy released by slight initial reclining movement of the backrest, the interlock latch prevents the inadvertent release of that energy by the mere handling of the chair in moving it. The invention, however, is equally applicable to the form of recliner, or rocker-recliner, which incorporates mechanisms of the so-called "two-way" and "three-way" types i.e. in which the self-contained footrest is initially extended by rearward movement of the chair seat and backrest together relative to the arms of the chair and as a preliminary to reclining the back. The physical handling of such chairs to move them from one place to another is frequently adequate to extend the footrest, which makes the chairs cumbersome to handle.

In either application of the occupant-actuated latch of the invention, the requirements of the host chair are simply that the seat of the chair be resiliently deflectable so as to provide sufficient motion and force under the occupant's weight to release the latch, the same being self-resetting when the occupant rises from the chair.

The invention and its application are described herein by reference to the accompanying drawings, in which:

FIGS. 1 and 2 are substantially identical to the correspondingly numbered drawings of my aforementioned application Ser. No. 885,585, a wooden seat frame and cushion spring platform having been added to FIG. 2 along with the latch mechanism of the present invention to illustrate their interrelation for subsequent operation of the latch mechanism when the chair is sat in.

FIG. 4 is a correspondingly enlarged fragmentary rear elevation of the chair mechanism as illustrated in FIG. 3;

Figure 3:
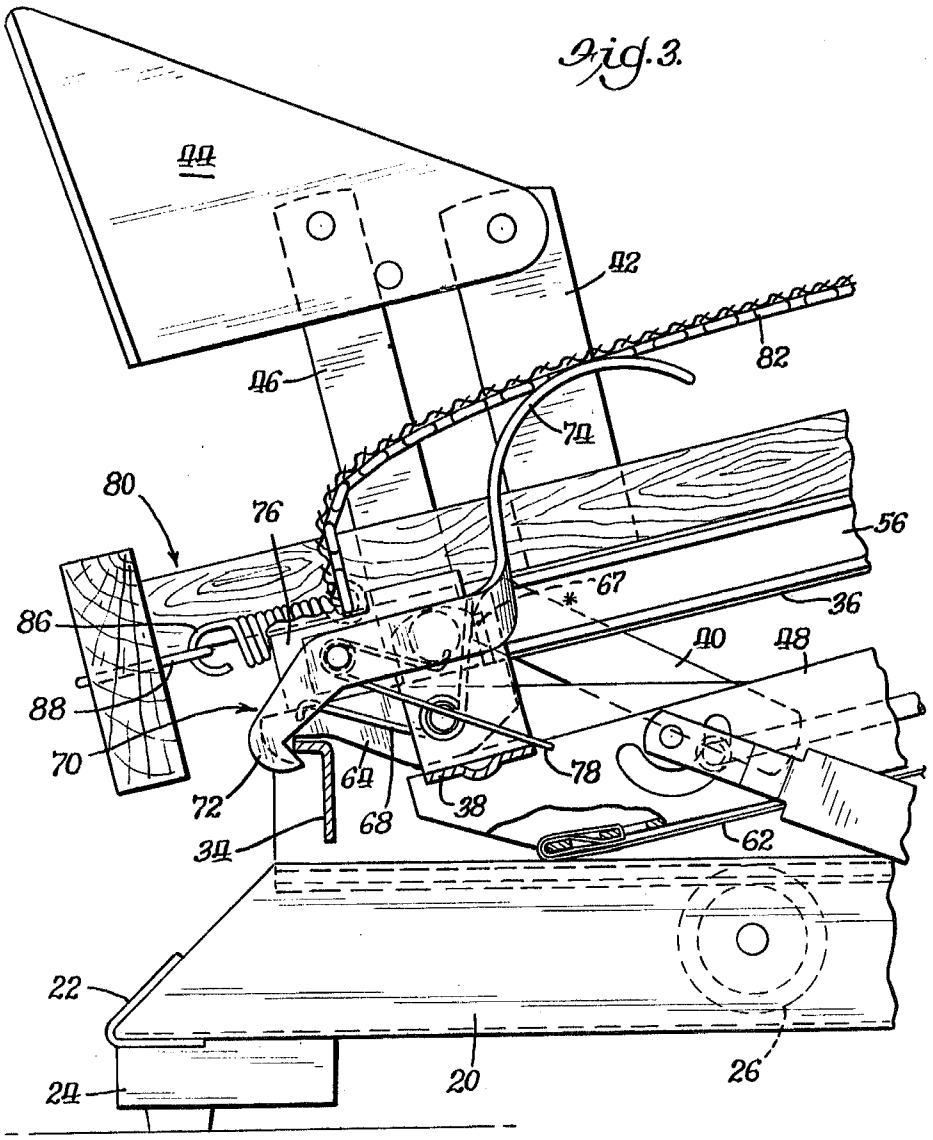
FIG. 3 is an enlarged fragmentary interior elevation corresponding in form to FIG. 2, but taken as a section in order to illustrate the latch mechanism of the invention from the inside of the chair.
Figure 7:
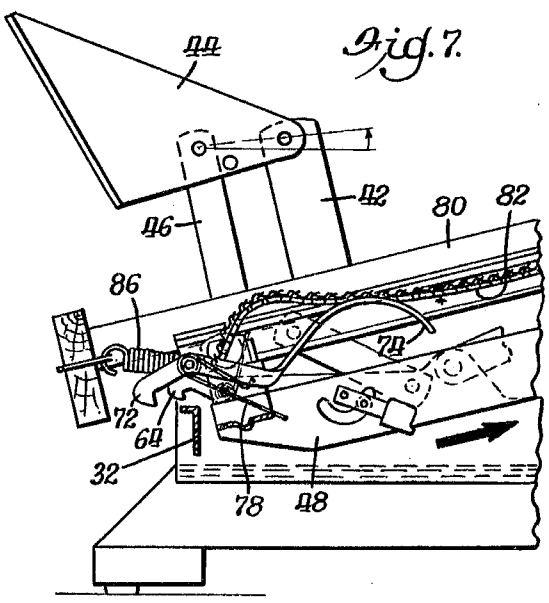
Figure 6:
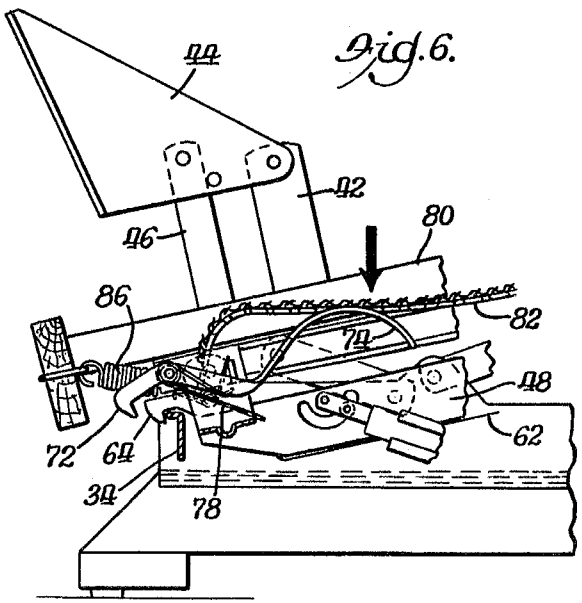
Figure 5:
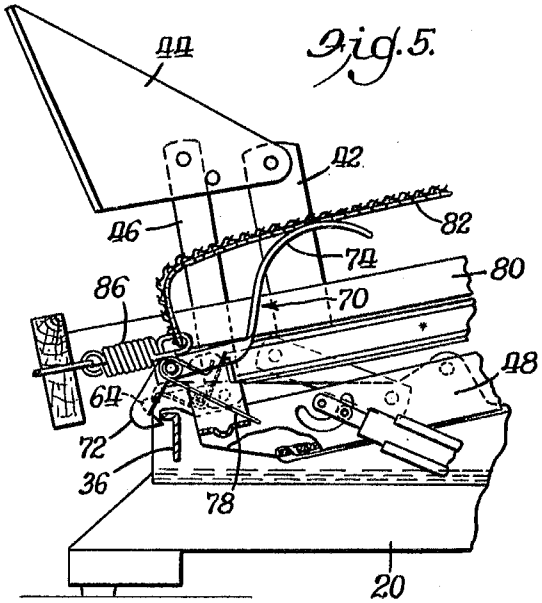
Figure 8:
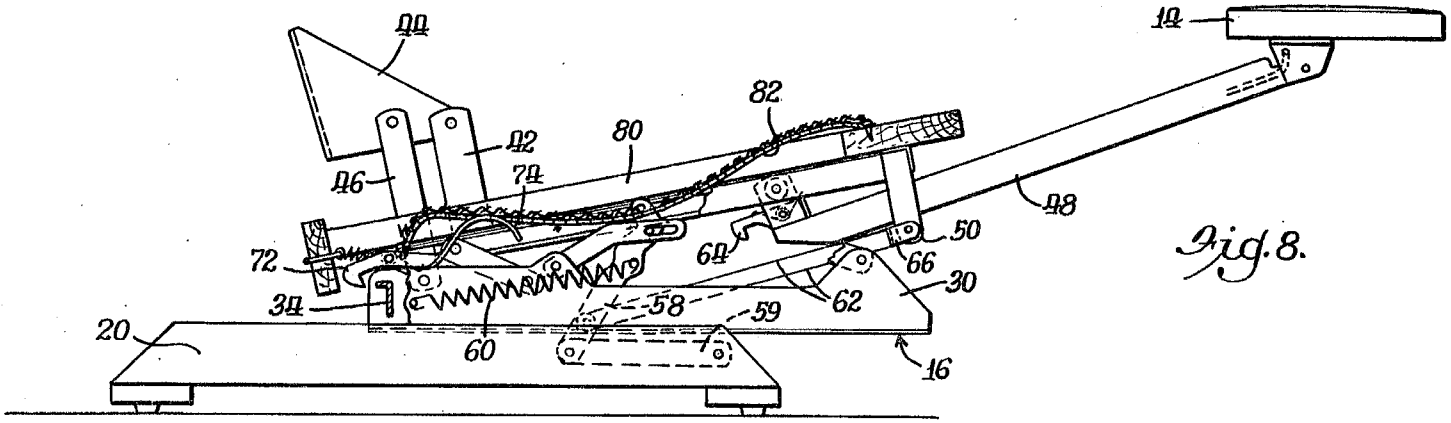

FIGS. 5, 6 and 7 are a series of fragmentary interior elevational views similar to FIG. 3, relating the operation of the latch or interlock mechanism of the invention to the operation of the chair of my copending application Ser. No. 885,585, with which the invention is here illustrated, FIG. 5 illustrating the condition of the parts when the chair is unoccupied, FIG. 6 when the chair is occupied but the footrest remains retracted and the backrest remains in the upright sitting position, and FIG. 7 showing the chair as occupied and with the backrest sufficiently reclined to release the footrest for forward movement; and FIG. 8 shows the chair as occupied, with the footrest extended and with the entire chair body moved forwardly upon the chair base to provide the necessary clearance for recline of the backrest.

Figure 1:
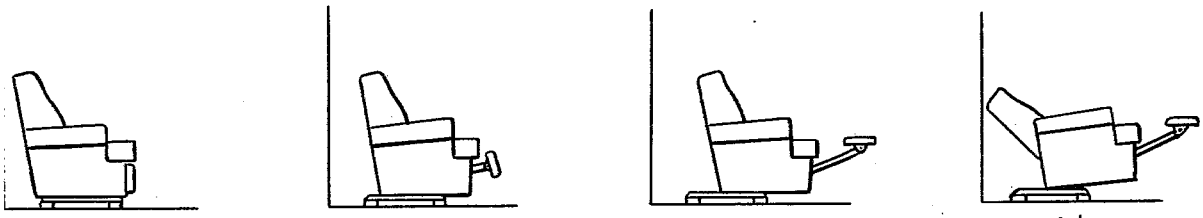
FIG. 1 is a series of four cartoons, *a, b, c* and *d*, which illustrate the action of the wall-clearing reclining chair to which I first applied the present invention.

As earlier noted, the interlocking latch mechanism of the invention is used to prevent the normal and intended operation of the chair unless the chair is occupied. To relate the foregoing specifically to the action depicted in the four cartoons of FIG. 1 of the drawings, none of the chair positions depicted in FIGS. 1*b*, 1*c* and 1*d* can be attained unless the chair is occupied. Similarly, when the chair is shifted from the position of full recline (FIG. 1*d*) to the so-called "TV" position (FIG. 1*c*) and subsequently shifted through the intermediate position of FIG. 1*b* to the upright sitting position of FIG. 1*a*, the occupant, by then rising from the chair, permits the latch to restore itself to prevent any further action until the chair is again occupied.

In its simple form illustrated, the interlock latch of the invention is a lever pivoted to the seat and having a hook which engages another part of the chair to prevent relative movement between the seat and that part. Another portion of the lever is disposed to be forcibly moved by the deflection of the seat to disengage the hook from the engaged chair part.

The Setting for the Illustrated Embodiment

The action of the wall-clearing reclining chair to which I first applied this invention, and with which it is here illustrated, will be understood from FIGS. 2 to 8, but reference may additionally be made to my copending application Ser. No. 885,585, which describes and illustrates the action of the overall mechanism in greater detail.

For present purposes, however, it should be understood that the chair comprises a seat 10, a backrest 12, and a self-contained retractable footrest 14, all mounted upon a carriage 16 which is shiftable forwardly and rearwardly on a normally-stationary base frame 18.

Both the seat and the backrest are mounted on the carriage for movement relative to the carriage and to each other during the reclining movement of the chair, and the footrest and its operating mechanism are carried by and suspended from the seat. In addition, the footrest operating mechanism is connected to the stationary base frame in such a way that the forward movement of the chair body on the base frame and the extension of the footrest occur as a coordinated essentially simultaneous movement either under the force of a driving spring or other self-contained instrumentally applied so as to cause either movement, with resulting causation of the other.

With that functional background, it may be noted that the normally stationary base frame 18 comprises a pair of side rails 20 in the form of upwardly-open channels (FIG. 4) connected together front and back by cross members 22 and elevated from the floor by attached blocks 24 at each of the four corners of the frame. Two rollers 26 are journaled in each side rail 20 on pins extending between the two flanges thereof, the outer flange being bent inwardly to provide a partial ledge 28 over the top of the channel.

The carriage upon which the chair body is supported comprises a pair of side plates 30 which are angular in cross section to provide an extended vertical flange to which to mount the chair linkage and a narrower horizontal flange as a runner 32 to support the carriage on the rollers of the stationary frame. The outwardly projecting runner 32 is disposed beneath the overlying flange 25 of the side rail of the base to prevent the separation of the carriage from the base. The carriage is guided in its fore and aft movement by the interior flanges on the carriage supporting rollers, and limited by the drive mechanism itself in a manner later described.

The two side plates 30 of the carriage are likewise cross-connected front and back by suitable cross members 34 which are also metal and angle shaped, the rear one of which forms part of the latch mechanism of the invention later to be described.

The seat 10 of the chair is likewise an open rectangular metal frame 36 whose front and side members are of angle iron and whose rear cross member 38 is a downwardly offset metal strap to which more detailed reference will later be made in describing the locus of the invention. The seat frame 36 is movably supported on the carriage 16 by a pair of links 40 at each side which connect it to the carriage in a four-bar linkage.

Secured to the metal seat frame 36 at each side is an upstanding bracket 42 to which the backrest mounting plate 44 is pivoted, the latter also being connected to the carriage side plate 30 by an upstanding support link 46 which is pivoted to both. It will be apparent from the linkage mechanism as thus far described that when the backrest of the chair is reclined, the backrest support link 46 serves as a jacking strut and the backrest as a jacking lever, turning about the upper end of the back support link 46 as a fulcrum, to lift the seat 10. The seat in turn is guided through a fixed path of movement by its double-link connection to the carriage 16, shifting forwardly as it is elevated, and carrying the lower end of the backrest 12 and the back support link 46 forwardly on the carriage as the backrest reclines.

The footrest 14 is mounted for turning movement at the front end of a pair of tubular rails 48 upon which the footrest is cantilevered in the extended position (FIG. 8). Each rail is supported at the front of the chair on a roller 50 journaled on a bracket depending from the front of the seat frame 36, and is supported at its rear end (FIG. 4) by a roller 52 journaled on an upstanding bracket 54 secured to the end of the rail to position the roller 52 for confined travel forward and back in a channel-shaped track 56 secured to the inside surface of the side member of the seat frame 36.

The mechanism for extending the footrest takes the form of a drive arm 58 pivoted to the side member of the seat frame and pivoted at its end to a toggle link 59 which, in turn, is pivoted to the base frame 18 by being journaled on the axle pin of the front carriage support roller 26. The arm is urged rearwardly by a tension spring 60 stretched between an anchoring rivet on the drive arm and a similar anchor on the side plate 30 of the carriage. A slotted stop link 61, pivoted to the side plate of the carriage encompasses at shoulder rivet on the drive arm 58 to limit the recline of the backrest, as more fully described in application Serial Number.

The drive arm 58 is connected to extend the footrest by a tape or band 62 which is secured to the footrest support rail 48 at the rear extremity thereof (FIGS. 2 and 3), extends forwardly along the underside of the rail, then around the forward rail-supporting roller 50, then rearwardly to pass around a sheave 63 journaled upon the drive arm 58 near its connection to the toggle link 59, and then forwardly to an anchoring clip 66 pivoted on the journal pin of the forward support roller 50.

In the sitting position of the chair (FIG. 2), with the carriage 16 positioned rearwardly on the chair base, the footrest drive arm 58 and the toggle link 59 are aligned to resist any movement of the carriage on the base frame due to exterior forces, i.e. the footrest drive arm 58 extends forwardly and downwardly from its pivotal connection to the seat frame 36 and the footrest is fully retracted and maintained in that position by latches still to be described, which are positioned at the rear end of the rails 48 to engage the rear cross member 34 of the carriage.

It will be appreciated, therefore, that when the latches which normally maintain the footrest in the retracted position are released, the driving spring 60 hauls the drive arm 58 rearwardly which has the dual effect of extending the footrest and propelling the carriage and surmounted chair parts forwardly on the base frame (FIG. 8). Conversely, when the occupant of the chair while sitting in the chair with the footrest extended (FIGS. 1c and 8) forceably draws the footrest to the retracted position by flexing his knees, the drive arm 58 is hauled forwardly on the seat frame by the tape 62 as the footrest is retracted, and simultaneously propels the carriage rearwardly on the base, both actions being against the force of the drive spring 60 stretched between the drive arm and the carriage. At the completion of the retraction movement, the footrest latches are reset, re-locking both the footrest and the chair body as a whole against forward movement.

In the specific embodiment illustrated, both the footrest latches and the seat-operated interlock latches of the invention share a common member, namely the rear cross member 34 of the carriage, and, being also located in close physical proximity, may conveniently be described together.

The Footrest and Seat-Operated Latches

Reference has earlier been made to the roller bracket 54 which supports the rear end of the footrest rail 48. The same bracket provides convenient site for the location of the footrest latch 64 (unobscured in FIG. 8), the latter taking the form of a simple rearwardly-extending hook which is pivoted to the upstanding bracket 54. The upper right hand corner of the bracket as seen in FIGS. 3 and 8 is turned inwardly as a stop tab 67 which is engaged by the shank of the latch 64 on the side of the pivot opposite the hook, and against which the shank is normally held by a torsion spring 68 coiled about the latch pivot with one end anchored against the stop tab 67 and the other hooked over the shank of the latch forcing the hook portion downwardly, or counterclockwise as seen in FIG. 3.

The footrest latch 64 is freed to permit the extension of the footrest by a slight initial reclining action of the backrest 12 (FIG. 7) sufficient to raise the entire seat frame 36 and with it the underslung footrest supporting rails 48 until the latches 64 at the rear ends of the rails are clear of the rear cross rail 34 of the carriage upon which they are hooked. That small amount of movement of the seat upwardly to free the footrest latches is permitted by a small clearance at the forward end of the slot in the stop link 61 earlier mentioned.

Obviously, to serve its function in the illustrated setting, the seat-actuated interlock latch of the invention must be arranged to defeat the same initial recline of the backrest which disengages the footrest latches 64, and, that is accomplished by the following mechanism which constitutes the invention.

Although no plan view of the illustrative chair is shown, it will be understood by those skilled in the art that, except where otherwise indicated in the text, the chair is symmetrical about a central vertical plane, with the linkages heretofore described duplicated as mirror images of each other at opposite sides of the chair. The same is true of the seat-actuated interlock latch of the invention.

Referring to FIGS. 3 and 4, the seat-operated latch of the invention takes the form of a first class lever 70 which is pivoted to an adjunct of the seat frame 36. On the rearward side of its pivot the latch is formed into a hook 72 which, in the normal latching position of the device, i.e. when the chair is unoccupied in the sitting position, is hooked beneath the rearwardly extending flange of the angle-iron cross member 34 of the movable carriage. When so disposed (FIGS. 3, 4 and 5) the hook prevents any upward or forward movement of the seat relative to the carriage.

The portion of the latch lever 70 on the side of the pivot opposite the hook 72 extends forwardly more or less in the plane of the metal seat frame, and is then twisted 90° and bent into a smoothly upwardly convex shank 74 which sweeps upwardly and forwardly beneath the underside of the upholstery of the seat. So positioned, the curved shank 74 is disposed to be forced downwardly by the deflection of the seat upholstery under the weight of the occupant, and, in so moving, swings the latch hook 72 rearwardly and free of the rear cross rail 34 which constitutes the cooperating latch part.

In the illustrated chair, the seat-operated latch lever 70 is conveniently mounted upon the downwardly offset rear cross member 38 of the metal seat frame of the chair, its preferred pivot location slightly rearwardly of the cross member 38 being conveniently reached by an extension bracket 76 in the form of a short section of angle-iron welded to the cross member at the juncture of its downwardly offsetting leg and the attaching flange which suspends it from the side members of the seat frame. The pivot of the latch lever 70 is thus situated more or less directly over the rear cross member 34 of the movable carriage, rendering the latch hook 72 effective to resist the raising of the seat. A torsion spring 78 encircling the latch lever pivot, with one leg resting against the front edge of the cross member 38 seat and the other hooked about the underside of the operating shank of the lever, biases the seat latch into the latched position.

Figure 2:
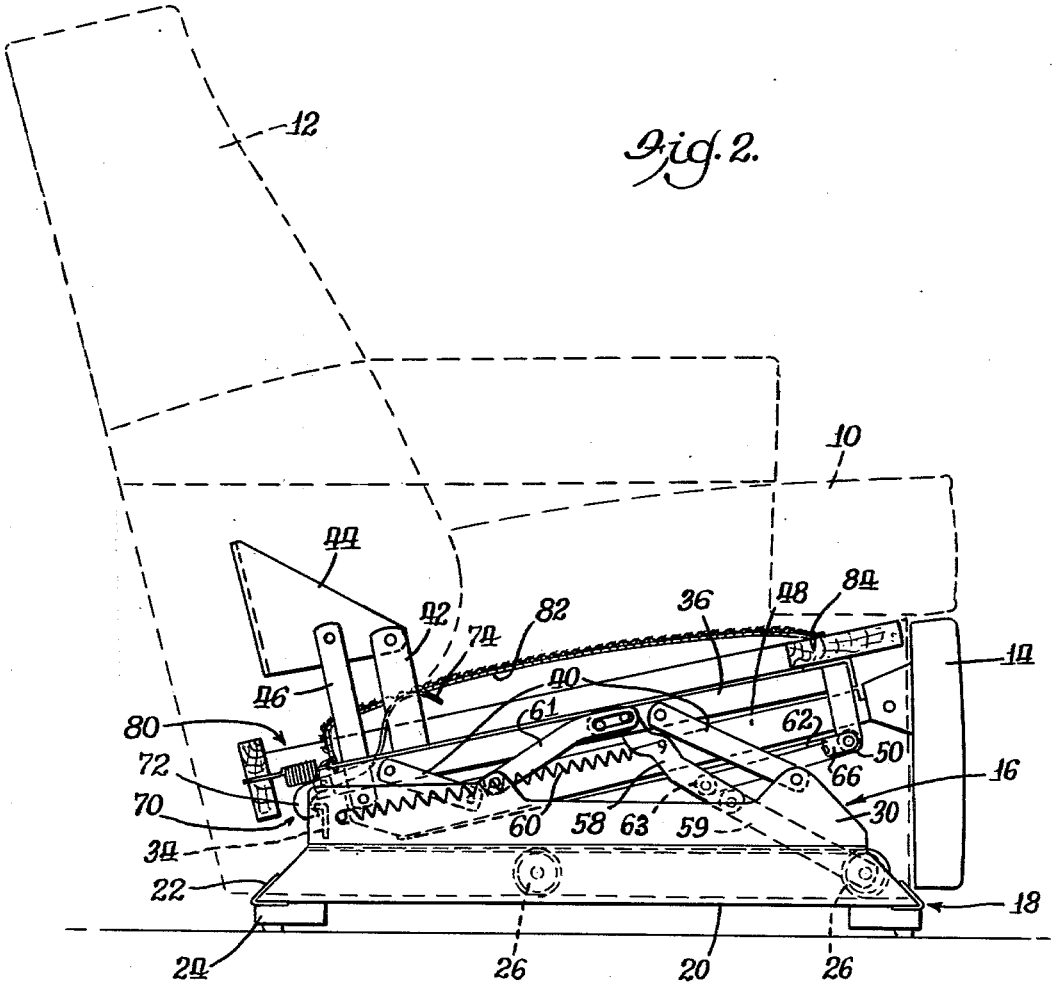
FIG. 2 is a side elevation of the operating mechanism of the chair in FIG. 1, with the contours of the chair shown in broken outline for orientation of the chair mechanism therein.
Figure 2:
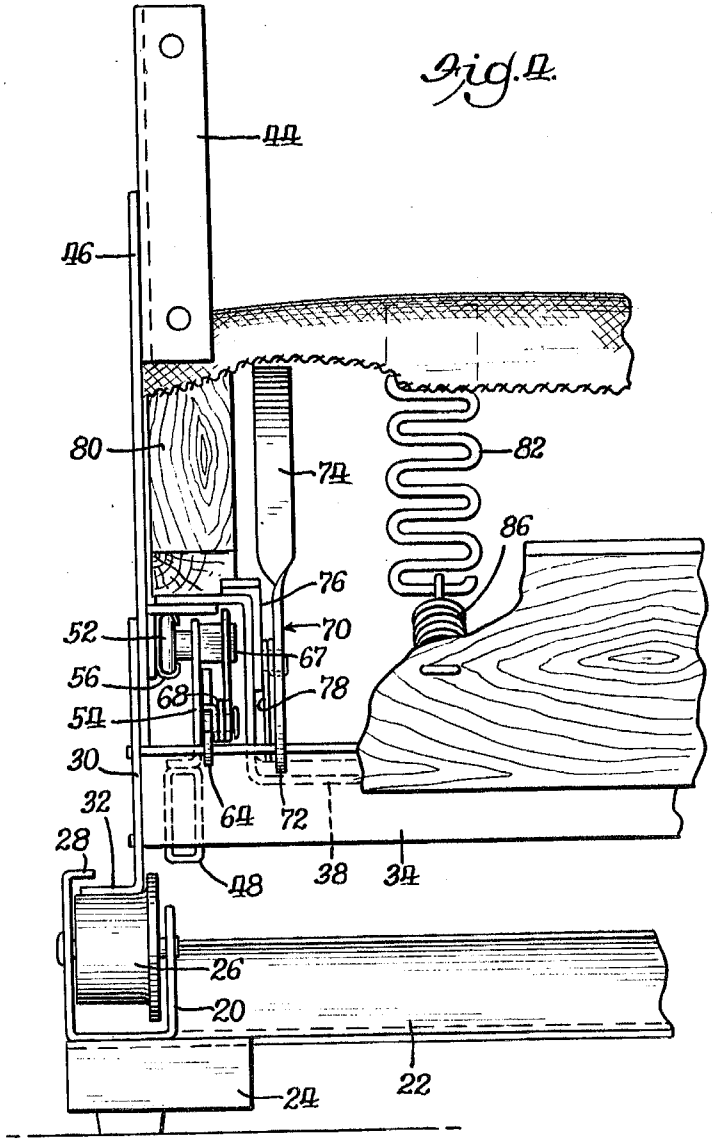

The spring base for the upholstery of the chair seat is constructed on a wooden seat frame 80 which is proportioned to be laid upon the metal seat frame 36 and secured thereto by screws. In the illustrated instance, the spring base for the seat comprises three or more prestressed serpentine or zig-zag springs 82 of the kind well-known in the art which are supported at their ends and prestressed to resume their unloaded upwardly-crowned profiles after being depressed over center by applied loads. At its front end each sinuous spring element 82 is journaled in a bearing clip 84 secured, as by nailing, to the front cross member of the wooden frame 80. At its rear end, the spring element is bent downwardly to provide a point of attachment substantially below the level of the supporting crown of the spring, and providing for the attachment of the rear end of the spring element, by means of a short helical 86, to an anchoring eye or loop 88 secured to the rear cross member of the wooden seat frame. In the unloaded condition of the spring foundation, the attaching helicals at the rear of the wooden seat frame extend forwardly approximately parallel to the plane of the seat, as shown in FIGS. 2, 3 and 5.

As will be understood by those skilled in the art, the serpentine spring elements 82 are stretched from front to rear of the seat frame, and are covered with appropriate insulation which may take the form of a heavy textile fabric such as burlap, or a fabric of parallel wires running from side to side of the seat frame, to bridge the spring elements in order to extend their support from side to side of the seat. Also as understood by those skilled in the art, although not specifically illustrated, such insulation is topped by further padding upon which the softer cushioning material of the seat is directly emplaced and the outer upholstery cover applied and stapled off to the wooden frame in a so-called "tight-seat" construction, or covered with minimal padding and a "deck sheet" if the "loose seat", or removable seat cushion construction, is preferred.

In either event, the rounded forwardly extending shank 74 of the latch lever 70 is disposed closely beneath if not in contact with the underside of the insulation which bridges the sinuous spring elements 82 so as to be depressed by the normal deflection of the seat under the weight of the occupant of the chair.

In the illustrated case, as seen in FIG. 4, the latch lever 70 is placed well to the side of the seat, where the deflection encountered is less than in the center but nevertheless sufficient under ordinary loads to rock the latch hook 72 free of the rear cross rail 34 of the carriage, with which it is normally engaged under the influence of the latch spring 78.

The deflected position of the spring foundation of the seat under the load of the occupant, and the consequent disabling of the seat latch, is illustrated in FIGS. 6, 7 and 8. In FIG. 6 position, again with due regard to the specific context in which the seat-operated latch of the invention is here illustrated, the footrest latches 64, which are under the conscious control of the occupant, remain engaged with the rear cross member of the carriage until subsequently freed by the elevation of the seat upon that initial slight amount of recline of the backrest (FIG. 7) permitted by the clearance at the front of the slot in the stop link 61. Thereupon, the footrest 14 and the chair body as a whole, move forward under the influence of energy stored in the drive spring 60, or by gravity as alternately illustrated in the aforementioned copending application Ser. No. 885,585.

When the chair is in the forward position and occupied, the several parts assume the configuration illustrated in FIG. 8, i.e. with the footrest fully extended and with the seat-operated latch 70 disengaged by the presence of the occupant in the chair. When the occupant elects to retract the footrest and return the chair rearwardly to the sitting position, he simply flexes his knees and draws the footrest inwardly, which in the manner already explained, also propels the carriage rearwardly on its stationary base, this action being accompanied by the resetting of the footrest latches 64 over the rear cross rail of the carriage when the footrest is fully retracted. The seat-operated latch 70, however, remains in the position depicted in FIG. 6 until the occupant subsequently rises from the chair, whereupon the seat-operated latch resumes the position of FIGS. 3 and 5, and the chair is thereupon relocked against any of the actions of which it is capable until it is once more occupied.

In essence, what the invention seeks to provide, irrespective of the setting, is a latch or interlock which prevents the actuation of the chair in its intended manner unless the chair is occupied, thus preventing any inadvertent actuation when the chair is being moved or incidentally handled.

Features of the invention believed new and patentable are set forth in the appended claims.

What is claimed is:

1. In a chair which includes a resiliently deflectable seat and provides for relative movement between the seat and another component of the chair under the control of the occupant, the improvement comprising a latch member mounted on said chair for movement between an effective position at which it prevents said relative movement and an ineffective position at which it permits said relative movement, said latch member being biased toward said effective position and being disposed for forceable movement to said ineffective position by the deflection of the seat under the weight of the occupant, thereby to permit said relative movement only when the chair is occupied.

2. The improvement of claim 1 in which the latch member is mounted on the seat and is normally engaged with said other component when in said effective position.

3. The improvement of claim 1 in which the seat comprises a supporting frame with a cushioning structure resiliently supported thereon and wherein the weight of the occupant causes a deflection of the underside of said cushioning structure relative to said supporting frame, said latch member comprising a lever pivoted on said supporting frame and having a hook which is engaged with said other component of the chair in said effective position, said lever having a portion disposed for contact by the underside of the cushioning structure upon the deflection of the latter to rock the lever to disengage the hook from said component thereby to permit said relative movement.

4. In a reclining chair having a deflectable seat and a self-contained footrest which is movably mounted on the chair for extension to a supporting position forwardly of the chair seat and retraction to a stowed position on the chair, drive means on the chair to drive the footrest from its stowed position to its supporting position, control means on the chair adapted for conscious operation by the occupant to activate said drive means at the will of the occupant to extend the footrest, and a seat-operated interlock disabling at least one of said drive means and control means when the chair is unoccupied, said interlock being disabled by the deflection of the seat under the weight of the occupant.

5. The arrangement of claim 4 in which the drive means stores energy derived from the retraction of the footrest by the occupant, the control means under the conscious control of the occupant is a first mechanical latch which normally secures the footrest in the stowed position, and the interlock is a second mechanical latch which prevents the release of the first mechanical latch when the chair is unoccupied.

6. In a reclining chair in which the seat and backrest are movably mounted on a base for forward movement thereon to permit the backrest of the chair to recline without obstruction and in which the seat is resiliently deflectable, drive means on the chair to drive the seat and the backrest forward on the base, control means on the chair adapted for conscious operation by the occupant to activate said drive means at the will of the occupant to move the seat and backrest forward on the base, and a seat-operated interlock disabling at least one of said drive means and control means when the chair is unoccupied, said interlock being disabled by the deflection of the seat under the weight of the occupant.

7. The arrangement of claim 6 in which control means under the conscious control of the occupant is a first mechanical latch which normally restrains the drive means and the interlock is a second mechanical latch which prevents the release of the first mechanical latch when the chair is unoccupied.

* * * * *

UNITED STATES PATENT AND TRADEMARK OFFICE

CERTIFICATE OF CORRECTION

PATENT NO. : 4,185,870

DATED : January 29, 1980

INVENTOR(S) : Carl B. Johnson

It is certified that error appears in the above-identified patent and that said Letters Patent are hereby corrected as shown below:

In Column 4, line 9, after "Serial Number", insert --885,585--.

Signed and Sealed this

*Thirteenth* Day of *May 1980*

[SEAL]

*Attest:*

SIDNEY A. DIAMOND

*Attesting Officer*

*Commissioner of Patents and Trademarks*